US005142711A

United States Patent [19]

Parikh

[11] Patent Number: 5,142,711

[45] Date of Patent: Sep. 1, 1992

[54] BIDET ASSEMBLY

[76] Inventor: Uday A. Parikh, 6737 Steeplechase Dr., Huntsville, Ala. 35806

[21] Appl. No.: 716,218

[22] Filed: Jun. 17, 1991

[51] Int. Cl.[5] ..... A47K 3/20

[52] U.S. Cl. ..... 4/420.4; 204/448

[58] Field of Search ..... 4/420.1, 420.5, 443–448

[56] References Cited

U.S. PATENT DOCUMENTS

| | | | |
|---|---|---|---|
| 2,528,095 | 10/1950 | Ward | 4/448 X |
| 3,015,826 | 1/1962 | Aranas | 4/420.4 |
| 3,134,985 | 6/1964 | Pasquale | 4/447 |
| 3,256,531 | 6/1966 | Arensberg | 4/448 |
| 3,386,105 | 6/1968 | Martini | 4/420.4 |
| 3,570,015 | 3/1971 | Rosengaus | 4/420.4 |
| 3,808,608 | 5/1974 | Caplan | 4/448 |
| 4,318,194 | 3/1982 | Pinkston | 4/661 X |
| 4,324,008 | 4/1982 | Carr | 4/445 |
| 4,691,391 | 9/1987 | Kuo | 4/447 |
| 5,101,520 | 4/1992 | Lockhart | 4/447 |

*Primary Examiner*—Henry J. Recla
*Assistant Examiner*—Robert M. Fetsuga
*Attorney, Agent, or Firm*—John C. Garvin, Jr.

[57] ABSTRACT

A bidet assembly for attachment to the upper surface of a conventional toilet bowl for cleansing and irrigating the anal and/or genital areas of a user of the toilet. The bidet assembly comprises one or more jet spray nozzles secured to the upper surface of the toilet bowl, one or more water supply hoses connected to the jet spray nozzles, a T-fitting connected to one of the water supply hoses and being in communication with the overflow tube and ballcock within the water reservoir tank, and an adjustable clamp for restricting the flow of water through the water supply hose. The bidet assembly uses fresh water from the ballcock to cleanse and irrigate the anal and/or genital areas of the user of the toilet during the refill cycle for the water reservoir tank.

17 Claims, 4 Drawing Sheets

BIDET ASSEMBLY

BACKGROUND OF THE INVENTION

1. Field of the Invention

This invention relates to a personal hygiene apparatus and more particularly to an assembly that may be attached to or be made a part of a conventional bathroom water closet for cleansing and irrigating the posterior or anal (hereinafter referred to as "anal") and genital or vaginal (hereinafter referred to as "genital") areas of users of the water closet, such areas of users being sometimes referred to herein generically as the crotch area.

2. Description of the Prior Art

Bidets have for many years been in use throughout the world, but primarily in Europe, for cleansing and irrigating a person's anal and/or genital areas by flushing them with a spray of water. Bidets are typically unitary structures having a single purpose and are normally provided in bathrooms along with conventional toilets.

The benefits to be desired by both male and female persons who use bidets are numerous. These benefits are readily recognized and appreciated by persons suffering from painful hemorrhoids, diarrhea or constipation and by post-surgery patients and post-childbirth patients. Additionally, people, both male and female, without any of the foregoing conditions or disabilities can enjoy the benefits of greater cleanliness and improved hygiene by regular use of a bidet.

The principal reason for bidets not becoming more commonplace in homes is the expense associated with the installation of a separate bidet in a bathroom. The bidet is generally very expensive and often there is inadequate space in a bathroom for installation of a separate bidet.

It is therefore desirable to provide a bidet, either as a retrofit or as original equipment for a conventional water closet. The prior art includes a limited number of devices for attachment to a conventional toilet bowl or toilet seat for cleansing and irrigating the anal and/or genital areas of a user. Examples of such prior art bidet attachments are shown and described in U.S. Pat. No. 3,256,531, 4,334,329, 4,807,311, 4,926,509, 4,259,754, and 4,995,121; each of which discloses an attachment or assembly for mounting either on the upper surface of a toilet bowl or the under surface of a toilet seat for cleansing and irrigating the anal and/or genital areas.

Most of the prior art devices have been extremely complex, unsightly, difficult to install and have failed to meet appropriate sanitary standards, thus they have not been readily accepted.

SUMMARY OF THE INVENTION

The instant invention relates to a bidet assembly for attachment to the upper surface of a toilet bowl which utilizes fresh water during the flush and refill cycle of the toilet tank, for cleansing and irrigating the anal and/or genital areas (crotch area) of users of the toilet. The bidet assembly of at least one embodiment of the present invention comprises a jet nozzle secured to the upper surface of the toilet bowl, a water supply hose or pipe connected at one of its ends to the jet nozzle, a T-fitting connected to the other end of the water supply hose, the T-fitting being in further communication with the conventional overflow tube and ballcock located in the water closet tank, and an adjustable clamp on the water supply hose for restricting the flow of water therethrough. The jet nozzle can be mounted on either the upper surface of the back side of the toilet bowl (between the hinges for the toilet seat) to cleanse and irrigate the anal area of the user or be mounted on the upper surface of the front of the toilet bowl for cleansing and irrigating the genital area of the user. Jet nozzles can also be mounted on the upper surface of both the back side and front side of the toilet bowl to selectively cleanse and irrigate either or both the anal and genital areas of the user.

It is an object of the present invention to provide a bidet assembly which can be easily installed on the toilet bowl of a conventional water closet.

It is a further object of the present invention to provide a bidet assembly which is simple and inexpensive in construction for attachment to the toilet bowl of a conventional water closet.

It is still a further object of the present invention to provide a bidet assembly which is simple and inexpensive in construction and operation, easily mounted on the toilet bowl of a conventional water closet, and which uses fresh water from the ballcock to cleanse and irrigate the anal and/or genital areas of the user during the refill cycle for the toilet tank.

These objects as well as other aspects, objects and advantages of the present invention will become apparent to those skilled in the art after reading the following description of the preferred embodiments in conjunction with the accompanying drawings, and the appended claims.

DETAILED DESCRIPTION OF THE INVENTION

Figure 1:
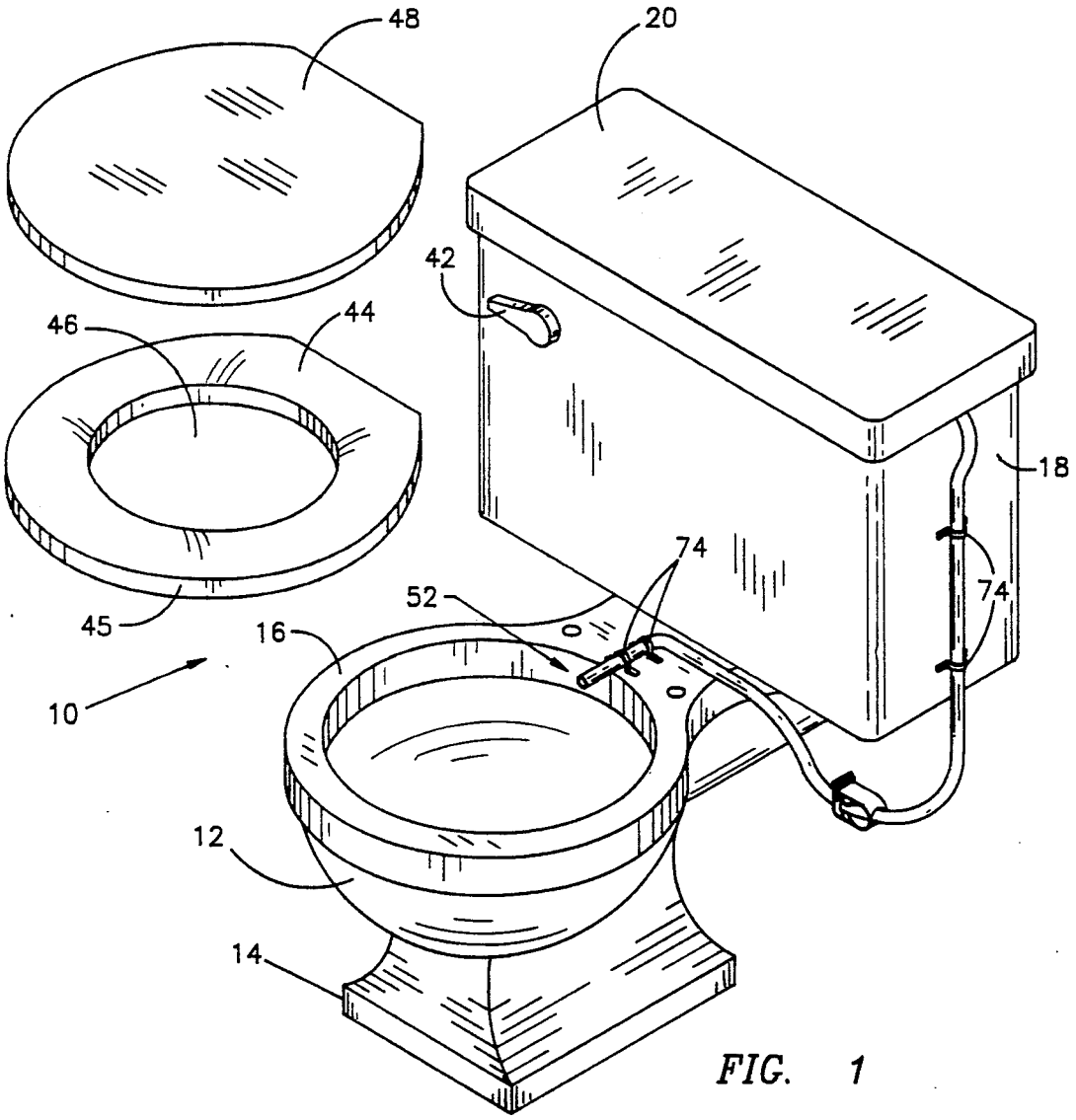
FIG. 1 is an exploded perspective view showing the bidet assembly of the present invention secured in one position on the toilet bowl of a conventional water closet.

Throughout the description which follows, like reference numerals will normally be used to indicate the same or like parts. Referring now to the drawings, reference numeral 10 generally designates a typical water closet which is installed in most bathrooms. Typical water closet 10 comprises a toilet bowl 12 having a base 14 and a generally flat, oval, upper surface 16; a water reservoir tank 18 (FIG. 2) having an opening 19 and a lid 20, a hollow overflow tube 22 having a conventional upper opening 23, a ballcock 24 having conventional outlets 25 and 26, in communication with an outside water line 28 having a water control valve 30 therein, a float 31 connected to ballcock 24 through float rod 32, an outlet valve 34, a flapper ball 36, a trip lever 38, a chain 40, and a handle 42; an oval seat 44 (FIGS. 1 and 3) having an oval outer edge 45 and an oval centralized opening 46; and a seat lid 48. Oval seat 44 and seat lid 48 are secured to each other and mounted to upper surface 16 of toilet bowl 12 by hinges (not shown) in the usual and conventional manner.

Figure 2:
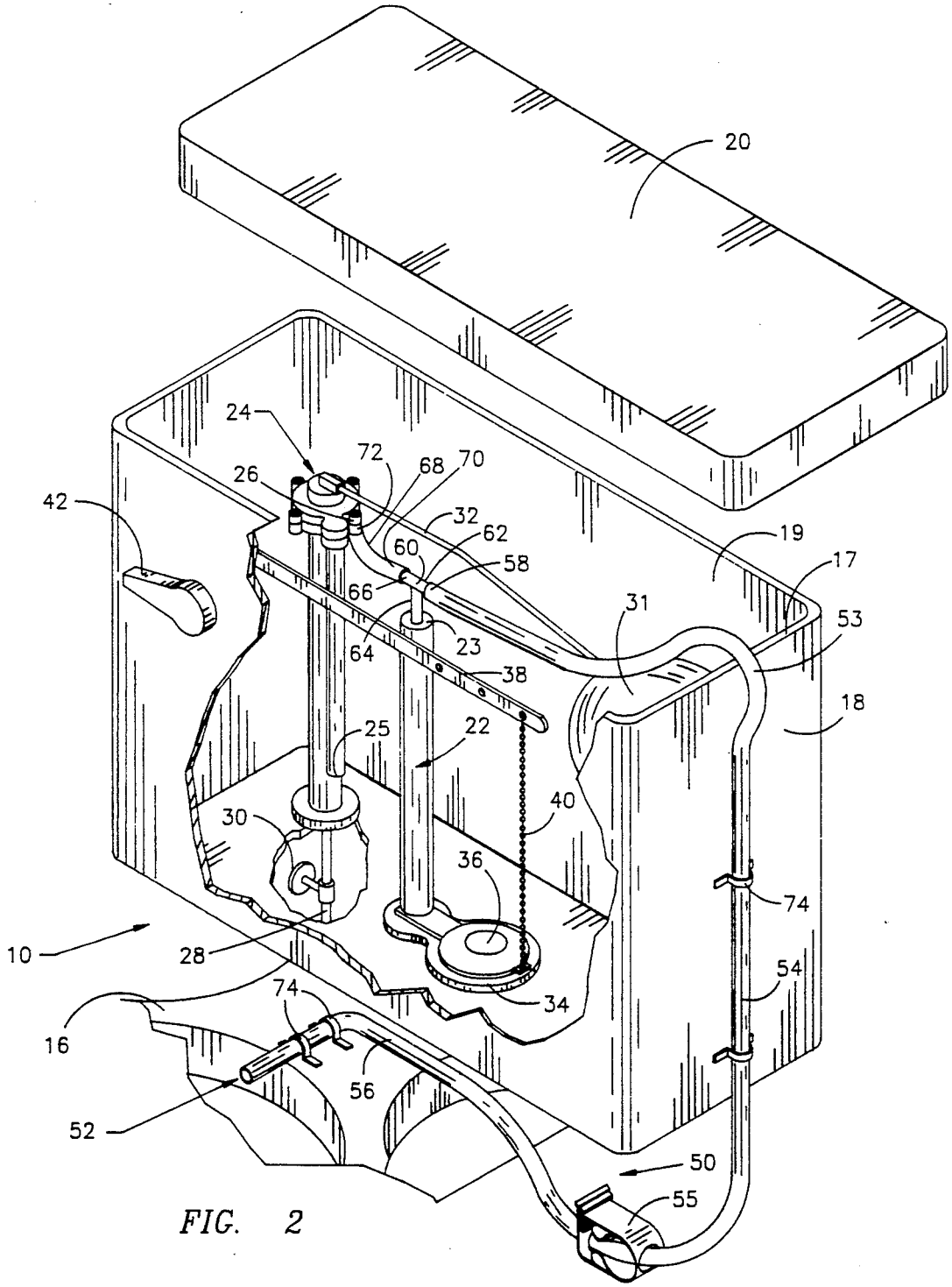
FIG. 2 is an exploded perspective view showing the bidet assembly of the present invention as shown in FIG. 1, with the front wall and bottom of the water reservoir tank being partially broken away to show the connection of the bidet assembly of the present invention to the water supply.

FIGS. 1 and 2 illustrate, by way of example, an embodiment of the present invention for cleansing and irrigating the anal area of a user. The bidet assembly of the present invention is generally designated by the reference numeral 50. Bidet assembly 50 comprises a jet spray nozzle 52, a water supply hose or pipe 54 having a first end portion 56, an intermediate portion 53 and a second end portion 58, a T-fitting 60 having openings or ports 62, 64 and 66, and a refill hose or pipe 68 having a first end portion 70 and a second end portion 72. Hose 54 has an adjustable clamp 55 thereon for restricting or stopping the flow of water therethrough. The first end portion 56 of water supply hose 54 is connected to jet nozzle 52 and the second end portion 58 of water supply hose 54 is connected to port 62 of the T-fitting 60 with its intermediate portion 53 passing between the upper edge 17 (FIG. 2) of reservoir tank 18 and lid 20 in an uncollapsed condition. An opening or notch (not shown) could be provided in either one wall of reservoir tank 18 or lid 20 for passage of the intermediate portion 53 of water supply hose 54. The first end portion 70 of refill hose 68 is connected to port 66 of T-fitting 60 and the second end portion 72 of refill hose 68 is connected to the conventional outlet 26 of ballcock 24. The port 64 of T-fitting 60 is mounted within conventional upper opening 23 of overflow tube 22. Jet nozzle 52 is secured to and mounted on the flat, upper surface 16 of toilet bowl 12 by one or more mounting brackets 74 by any conventional securing means such as adhesives or nuts and bolts.

Jet nozzle 52, water supply hose or pipe 54 and refill hose 68 can be made of any conventional material such as plastic or rubber. Preferably, water supply hose 54 and refill hose 68 are made of a flexible plastic material. Preferably, spray nozzle 52 is made of a hard, rigid, plastic material. It should be readily understood, however, that a separate spray nozzle 52 made from a hard plastic material is not essential to the invention as the first end portion 56 of water supply hose 54 could serve as the nozzle for dispensing water to cleanse and irrigate the crotch area of a user. T-fitting 60 can be made of any conventional material such as plastic, nylon, brass or steel. Preferably, T-fitting 60 is made of a hard plastic material.

Figure 3:
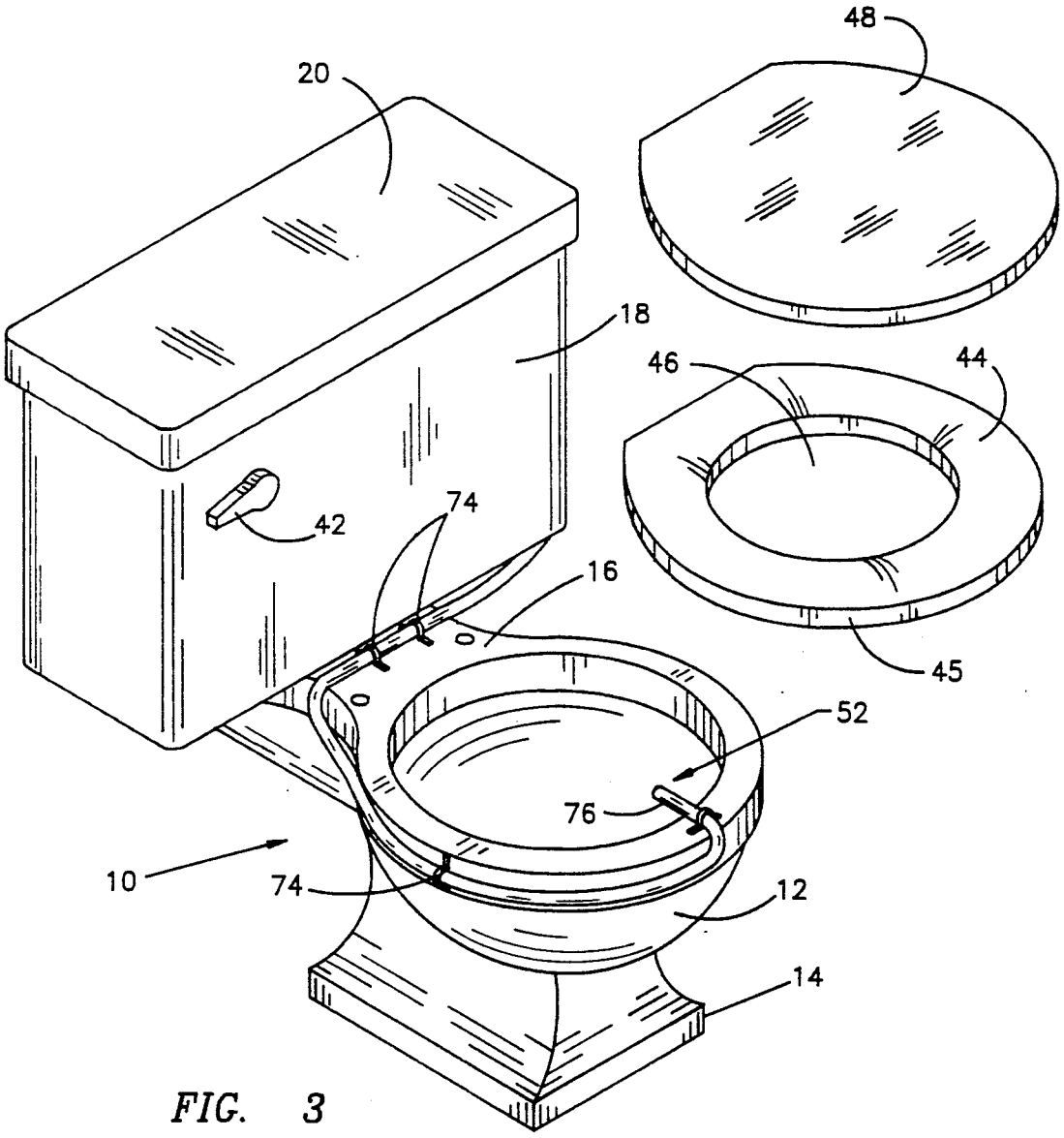
FIG. 3 is an exploded perspective view showing the bidet assembly of the present invention secured in a second position on the toilet bowl of a conventional water closet.

FIG. 3 illustrates, by way of example, an embodiment of the present invention for cleansing and irrigating the genital area of the user. This embodiment is very similar to that for cleansing and irrigating the anal area of the user except for the place of mounting on the flat upper surface 16 of toilet bowl 12. If deemed necessary, additional brackets such as brackets 74 can be utilized to secure flexible supply tube hose 54 to the side of toilet bowl 12 and water reservoir tank 18.

Figure 5:
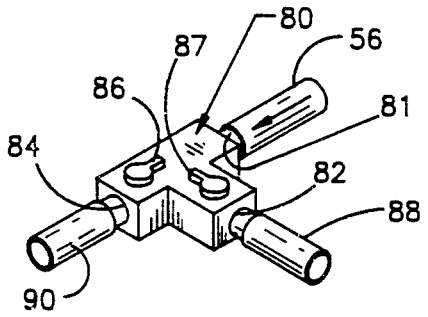
FIG. 5 is a pictorial view showing the valve means utilized in the embodiment of FIG. 4 for selectively causing flow of water to either or both jet nozzles.
Figure 4:
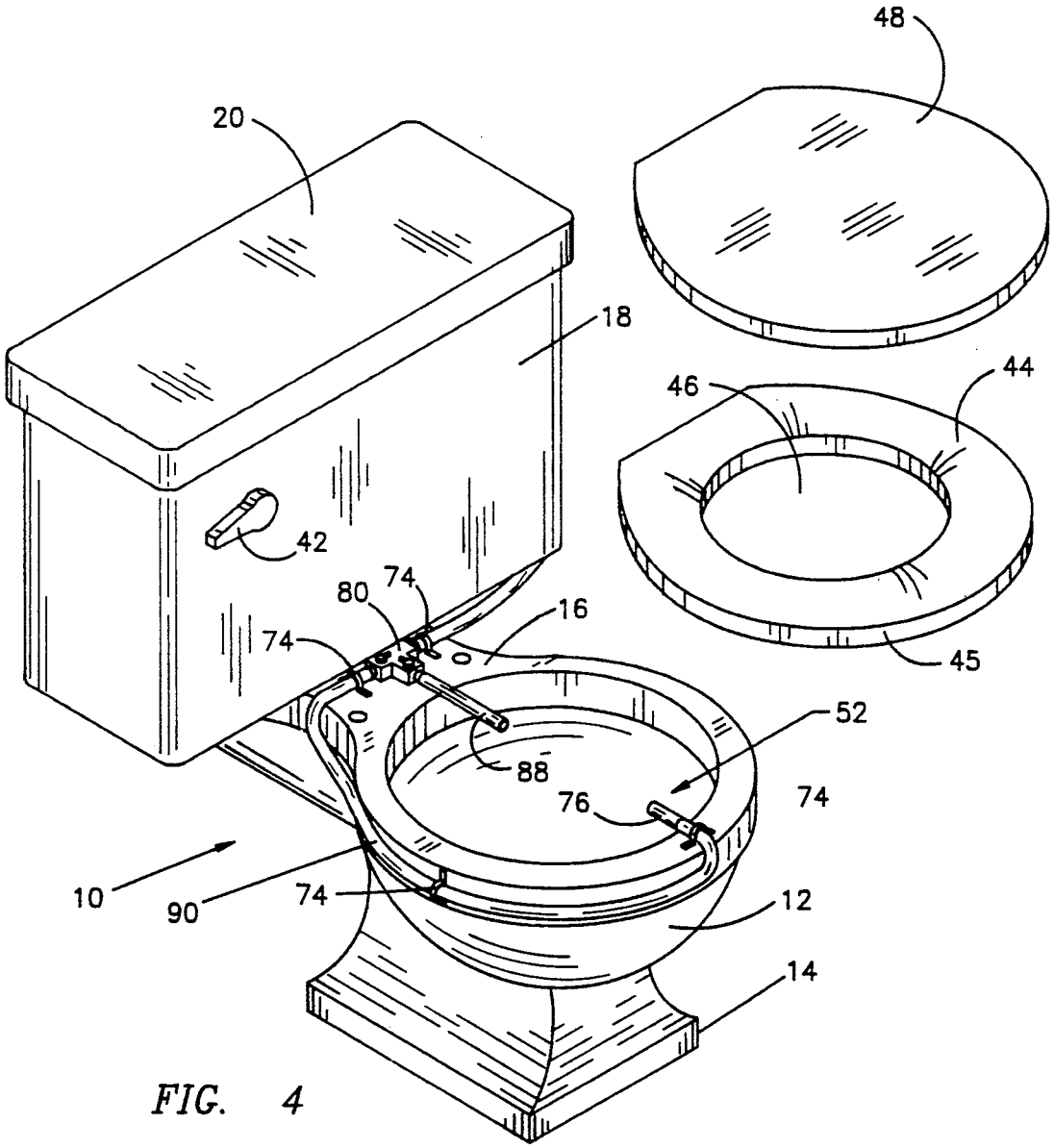
FIG. 4 is an exploded perspective view of another embodiment of the bidet assembly of the present invention with a jet nozzle being secured at two locations to the upper surface of a toilet bowl of a conventional water closet.

FIGS. 4 and 5 illustrate, by way of example, an embodiment of the present invention for selectively cleansing and irrigating either or both the anal and/or genital areas of the user. This embodiment combines the structures of the embodiments illustrated in FIGS. 1 and 2 and 3 and incorporates valve means 80 in water supply hose 54 which allows water to flow through either or both of the jet spray nozzles 76 and 88. Valve means 80 includes a first port 81, a second port 82, a third port 84, a first gate valve 86 mounted in port 84 and a second gate valve 87 mounted in port 82. Port 81 of valve means 80 is connected to first end portion 56 of water supply hose 54, port 82 of valve means 80 is connected to the jet nozzle 88 secured to the back side of the upper surface 16 of toilet bowl 12, and a hose member 90 is connected to port 84 of valve means 80 at one of its ends and to the jet nozzle 76 secured to the front side of the upper surface 16 of toilet bowl 12. The actuation of either or both gate valves 86 or 87 permits a user to allow water to flow through either one or both of jet nozzles 76 and 88 to cleanse or irrigate either or both the anal and/or genital areas of the user.

In operation, after the bidet assembly has been assembled, mounted and connected as shown in FIGS. 1 and 2, a user, operates handle 42 which actuates trip lever 38 and chain 40 to lift flapper ball 36 from its seat in outlet valve 34, thus causing water to exit from the interior of reservoir tank 18, to flush the waste from toilet bowl 12. As soon as water is removed from reservoir tank 18, the lowering of float 31 actuates ballcock 24 which causes fresh water to flow through the conventional outlets 25 and 26 of ballcock 24, at which time flapper ball 36 closes outlet valve 34. The water flowing through outlet 25 of ballcock 24 refills the reservoir tank 18. The water flowing through outlet 26 passes through refill hose 68 to T-fitting 60 where approximately fifty percent (50%) of the water passes through port 64 into overflow tube 22 and into the trap (not shown) of toilet bowl 12 with the other approximately fifty percent (50%) of the water passing through port 62 of T-fitting 60, water supply hose 54 and jet spray nozzle 52 where the water is discharged to clean and irrigate the anal area of the user. The water flows through water supply hose 54 and jet spray nozzle 52 from the time of actuation of ballcock 24 to its deactivation by float 31 when tank reservoir 18 has been refilled The anal areas of the user could be further cleansed or irrigated by repeating this procedure.

The bidet assembly depicted in FIG. 3 would operate in substantially the same way to cleanse or irrigate the genital area of the user.

The bidet assembly depicted in FIGS. 4 and 5 operates similarly to those depicted in FIGS. 1 and 2 and FIG. 3 except that valve means 80 allows the user, by actuating the gate valves 86 and/or 87, to selectively cleanse and irrigate either the anal or genital areas of the user.

While the above description constitutes preferred embodiments of the present invention, it will be appreciated that the invention is susceptible to modification, variation and change without departing from the proper scope and fair meaning of the accompanying claims.

I claim:

1. A bidet assembly adapted for use with a water closet having a water reservoir tank including a ballcock having water inlet and water outlet means in communication with an external water source, a hollow overflow tube having an upper opening, reservoir tank outlet means, a toilet bowl having a flat uppermost surface and being in communication with said reservoir tank outlet means, means for releasing water from said water reservoir tank through said reservoir tank outlet means to said toilet bowl, and means for actuating said ballcock for admitting water from said external water source through said water outlet means into said water reservoir tank, said bidet assembly comprising conduit means having a first end portion adapted to communicate with said water outlet means of said ballcock and a second end portion adapted to be secured to said toilet bowl uppermost surface, a connecting member having a plurality of ports, a first of said ports being disposed for receiving water from said ballcock outlet means, and a second of said ports being connected to said conduit means first end portion to provide water from said ballcock to the crotch area of the user of said water closet in response to actuation of said ballcock actuating means.

2. The bidet assembly of claim 1 wherein said bidet assembly includes a refill hose for connecting said ballcock water outlet means to said connecting member first port.

3. The bidet assembly of claim 2 wherein said connecting member is in the form of a T-fitting having said first and second ports and a third port, said third port adapted to being mounted in and in communication with said upper opening in said overflow tube.

4. The bidet assembly of claim 3 wherein said conduit means comprises a water supply hose.

5. The bidet assembly of claim 3 wherein said conduit means second end portion further includes a reinforced jet spray nozzle which is adapted to be secured to said uppermost surface of said toilet bowl.

6. The bidet assembly of claim 5 wherein said jet spray nozzle is adapted to be secured to said uppermost surface on a back side of said toilet bowl at a location in close proximity to said water reservoir tank for cleansing and irrigating the anal or posterior area of the user of said water closet.

7. The bidet assembly of claim 5 wherein said jet spray nozzle is adapted to be secured to said uppermost surface of said toilet bowl on a front side of said toilet bowl so as to cleanse and irrigate the vaginal or genital area of the user of said water closet.

8. The bidet assembly of claim 5 wherein said conduit means has means associated therewith for restricting the flow of water therethrough.

9. The bidet assembly of claim 3 wherein said toilet bowl includes front and back sides and wherein said conduit means second end portion includes a first jet nozzle adapted to be secured to said uppermost surface on said back side of said toilet bowl, a second jet nozzle adapted to be secured to said uppermost surface on said front side of said toilet bowl, and valve means for selectively directing the flow of water to one or both of said first and second jet nozzles.

10. The bidet assembly of claim 9 wherein said valve means includes one or more gate valves.

11. A bidet assembly adapted for use with a water closet having a water reservoir tank which includes a ballcock having two water outlets and being connected to an external water source, a hollow overflow tube having an upper opening, a water outlet valve seat, a flapper ball adapted for engagement and disengagement with said water outlet valve seat, a handle, and linkage means connecting said flapper ball and handle for engaging and disengaging said flapper ball with said water outlet valve seat; a toilet bowl including a flat upper surface and front and back sides; and a toilet seat connected to said flat upper surface of said toilet bowl; said bidet assembly comprising:

a jet nozzle adapted to be secured to said upper surface of said toilet bowl;

conduit means having a first end portion and a second end portion, said conduit means being in communication at its said first end portion with said jet nozzle;

a T-fitting having first, second and third ports, said first port being secured to and in communication with said second end portion of said conduit means and said second port being adapted to be mounted in and in communication with said upper opening in said overflow tube; and a refill tube having a first distal end secured to and in communication with said third port of said T-fitting and a second distal end adapted to be secured to and in communication with one of said water outlets of said ballcock, whereby water flows from said one water outlet of said ballcock through said refill tube, said T-fitting, said conduit means and said spray nozzle as a result of actuation of said ballcock of said water reservoir tank to cleanse and irrigate an area of the body of the user of said water closet.

12. The bidet assembly of claim 11 wherein said jet nozzle is adapted to be secured to said upper surface on said back side of said toilet bowl at a location in close proximity to said water reservoir tank for cleansing and irrigating the anal or posterior area of the user of said water closet.

13. The bidet assembly of claim 11 wherein said jet nozzle is adapted to be secured to said upper surface of said toilet bowl on said front side of said toilet bowl so as to cleanse and irrigate the vaginal or genital area of the user of said water closet.

14. The bidet assembly of claim 12 wherein said conduit means has means associated therewith for closing said conduit means for restricting the flow of water therethrough.

15. The bidet assembly of claim 11 further comprising a second jet nozzle adapted to be secured to said upper surface of said toilet bowl and wherein said conduit means includes valve means in communication with said jet nozzle and said second jet nozzle for selectively directing the flow of water to either or both of said jet nozzle and said second jet nozzle.

16. The bidet assembly of claim 15 wherein said valve means includes one or more gate valves.

17. A bidet assembly adapted for use with a water closet having a water reservoir tank which includes a ballcock having two water outlets and being connected to an external water source, a hollow overflow tube having an upper opening, a water outlet valve seat, a flapper ball adapted for engagement and disengagement with said water outlet valve seat, a handle, and linkage means connecting said flapper ball and handle for engaging and disengaging said flapper ball with said water outlet valve seat; a toilet bowl including a flat upper surface; and a toilet seat connected to said flat upper surface of said toilet bowl; said bidet assembly comprising:

a first jet nozzle adapted to be secured to the front of said toilet bowl;

a second jet nozzle adapted to be secured to the rear of said toilet bowl;

a first water supply hose having a first end portion and a second end portion;

a second water supply hose having a first end section and a second end section, said second end section being secured to and in communication with said first jet nozzle.

a valve including a first port secured to and in communication with said first end portion of said first water supply hose, a second port secured to and in communication with said second jet nozzle, and a third port secured to and in communication with said first end section of said second water supply hose;

a T-fitting having first, second and third ports, said first port being secured to and in communication with said second end portion of said first water supply hose and said second port being mounted in and in communication with said upper opening in said overflow tube; and a refill tube having a first distal end secured to and in communication with said third port of said T-fitting and a second distal end adapted to be secured to and in communication with one of said water outlets of said ballcock, whereby water flows from said one water outlet of said ballcock through said refill tube, said T-fitting, said first water supply hose, said valve and either or both said first jet nozzle and said second jet nozzle depending upon the setting of said valve as a result of actuation of said ballcock of said water reservoir tank to cleanse and irrigate one or or more areas of the body of the user of said water closet.

* * * * *